US009808068B2

(12) United States Patent
Yamasaki

(10) Patent No.: US 9,808,068 B2
(45) Date of Patent: Nov. 7, 2017

(54) DRAWING APPARATUS AND OPERATION CONTROL METHOD THEREOF

(71) Applicant: CASIO COMPUTER CO., LTD., Shibuya-ku, Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/369,295

(22) Filed: Dec. 5, 2016

(65) Prior Publication Data

US 2017/0181521 A1 Jun. 29, 2017

(30) Foreign Application Priority Data

Dec. 28, 2015 (JP) ..... 2015-255679

(51) Int. Cl.

| | |
|---|---|
| ***G06K 15/22*** | (2006.01) |
| ***A45D 29/22*** | (2006.01) |
| ***A45D 34/04*** | (2006.01) |
| *A45D 29/00* | (2006.01) |
| *A45D 34/00* | (2006.01) |

(52) U.S. Cl.

CPC ..... *A45D 29/22* (2013.01); *A45D 34/04* (2013.01); *A45D 2029/005* (2013.01); *A45D 2034/005* (2013.01)

(58) Field of Classification Search

None

See application file for complete search history.

(56) References Cited

U.S. PATENT DOCUMENTS

| | | | | |
|---|---|---|---|---|
| 6,067,996 | A * | 5/2000 | Weber | A45D 34/04 132/200 |
| 6,286,517 | B1 * | 9/2001 | Weber | A45D 29/00 132/200 |
| 6,525,724 | B1 * | 2/2003 | Takami | A45D 29/00 345/418 |
| 8,757,171 | B2 * | 6/2014 | Goff | A45D 29/00 101/35 |
| 2012/0147113 | A1 * | 6/2012 | Yamasaki | A45D 29/00 347/104 |
| 2013/0242019 | A1 * | 9/2013 | Bitoh | A45D 29/00 347/104 |
| 2014/0267517 | A1 * | 9/2014 | Yamasaki | B41J 3/4073 347/101 |

FOREIGN PATENT DOCUMENTS

| | | |
|---|---|---|
| JP | 2000194838 A | 7/2000 |

* cited by examiner

*Primary Examiner* — Ted Barnes
(74) *Attorney, Agent, or Firm* — Holtz, Holtz & Volek PC

(57) ABSTRACT

A drawing apparatus includes an object insertion portion into which an object is inserted, the object being at least one finger or toe having a nail, a plurality of pressing units which apply pressing forces to the object inserted in the object insertion portion to hold the object in the object insertion portion and a processor which controls the pressing forces applied by the plurality of pressing units respectively to adjust an inclination in a width direction of the nail of the object inserted in the object insertion portion.

19 Claims, 9 Drawing Sheets

DRAWING APPARATUS AND OPERATION CONTROL METHOD THEREOF

CROSS-REFERENCE TO RELATED APPLICATIONS

This application is based upon and claims the benefit of priority from the prior Japanese Patent Application No. 2015-255679, filed Dec. 28, 2015, the entire contents of which are incorporated herein by reference.

BACKGROUND OF THE INVENTION

1. Field of the Invention

The present invention relates to a drawing apparatus and an operation control method thereof.

2. Description of the Related Art

A drawing apparatus configured to draw a nail design on a nail is conventionally known. Japanese Patent Application Laid-Open No. 2000-194838, for example, describes a drawing apparatus for drawing a design picture on a fingernail where a holder for locking a finger is provided on the aforementioned drawing apparatus so as to hold a finger having a nail on which the nail design is drawn.

In the drawing apparatus described in the above literature, the inclination of the finger with respect to the extending direction is not considered. Therefore, the finger having a nail on which drawing is to be made is held with being inclined to the right or left with respect to a rotation axis where the extending direction is assumed to be the rotation axis, thereby the nail on which drawing is to be made is inclined to one side in the width direction in some cases.

In this case, the design picture on the nail is sometimes distorted or a part of the design picture cannot be drawn on the nail because it is difficult to draw the design picture on the nail in some cases.

Even if the finger itself is not inclined, the nail may be inclined to one side in the width direction of the nail in certain people. Also in this case, the design picture drawn on the nail is distorted or a part of the design picture cannot be drawn on the nail because it is difficult to draw the design on the nail in some cases similarly to the above.

SUMMARY OF THE INVENTION

The present invention is advantageous in that it can provide a drawing apparatus capable of holding a finger or a toe in an appropriate state so as to facilitate the drawing of a design on its nail and an operation control method of the drawing apparatus.

In order to achieve the above advantage, the present invention provides a drawing apparatus including: an object insertion portion into which an object is inserted, the object being at least one finger or toe having a nail; a plurality of first pressing units which apply pressing forces to the object inserted in the object insertion portion to hold the object in the object insertion portion; and a processor which controls the pressing forces applied by the plurality of first pressing units respectively to adjust an inclination in a width direction of the nail of the object inserted in the object insertion portion.

In order to achieve the above advantage, the present invention provides an operation control method of a drawing apparatus, wherein: the drawing apparatus includes an object insertion portion into which an object is inserted, the object being at least one finger or toe having a nail and a plurality of first pressing units which apply pressing forces to the object inserted in the object insertion portion to hold the object in the object insertion portion; the operation control method includes a first pressing unit control step of controlling the pressing forces applied by the plurality of first pressing units respectively to adjust an inclination in a width direction of the nail of the object inserted in the object insertion portion.

DETAILED DESCRIPTION OF THE INVENTION

Figure 1:
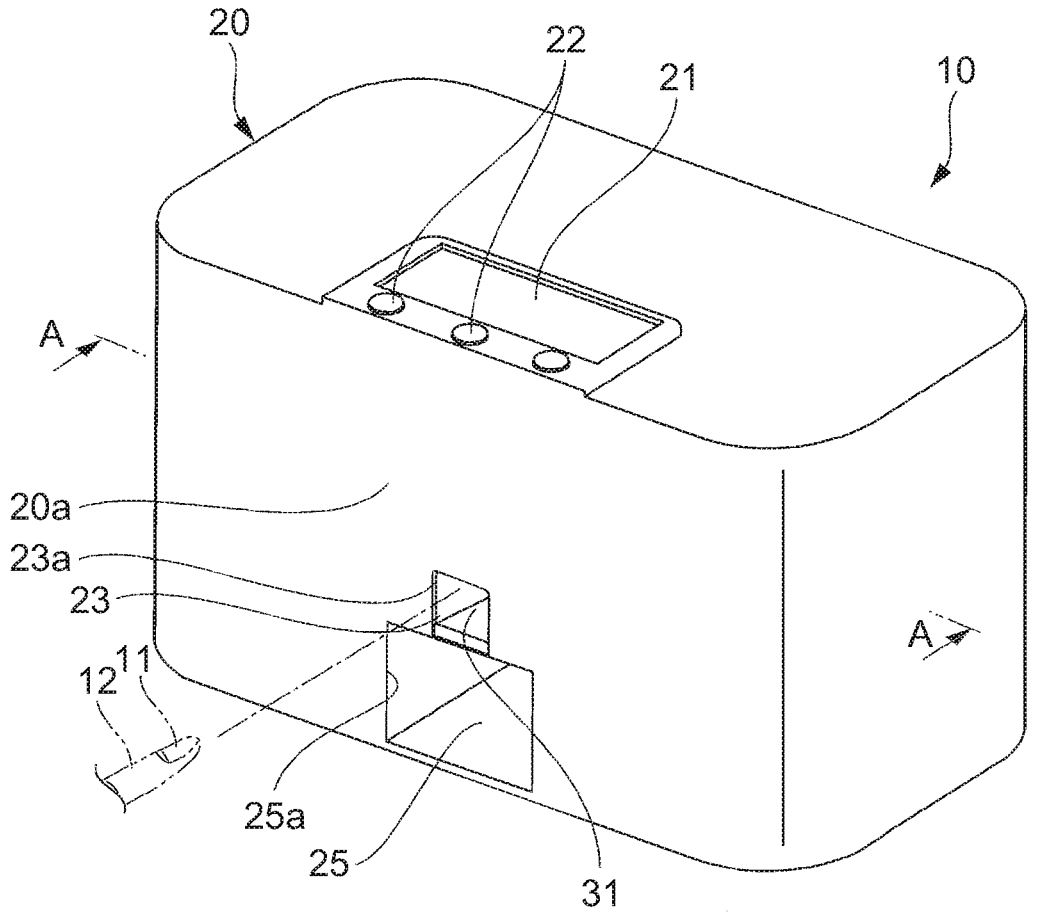
FIG. 1 is a perspective view showing an appearance of a drawing apparatus according to an embodiment of the present invention.

Modes for carrying out the present invention (hereinafter, referred to as "embodiments") will be described in detail below with reference to accompanying drawings.

Throughout the description of the embodiments, the same elements are denoted by the same numbers.

In the following embodiments, a description will be made assuming that a finger is an object and that a drawing apparatus performs drawing on the surface of a fingernail. The drawing object in the present invention, however, is not limited to the surface of the fingernail; the object may be, for example, a toe and the surface of a toenail may be a drawing object surface.

(Overall Configuration of Drawing Apparatus)

Referring to FIGS. 1 to 6, embodiments of a drawing apparatus 10 according to the present invention will be described.

FIG. 1 is a perspective view showing an appearance of the drawing apparatus 10.

As shown in FIG. 1, the drawing apparatus 10 is an apparatus which has a drawing function and is used to draw a design picture onto a nail 11 of a human finger 12.

The drawing apparatus 10 includes a box-shaped casing 20, which has an upper surface (top board) on which a display unit 21 and an operation unit 22 are disposed.

The display unit 21 is used to display the progress of drawing or a message to a user.

The operation unit 22 is used to perform an input operation performed by a user, for example.

An insertion opening 23*a* for a first finger insertion portion (object insertion portion) 23 opens at a lower center of a front section 20*a* of the casing 20. The details of the first finger insertion portion 23 will be described later.

An insertion opening 25*a* for a second finger insertion portion 25 opens beneath the first finger insertion portion 23.

The second finger insertion portion 25 is a space into which fingers other than the finger as a drawing object 12 among a plurality of fingers belonging to one hand.

The second finger insertion portion 25 is a space, which is formed to extend backward, namely in the insertion direction of the finger 12, from the front section 20*a* of the casing 20 and which is independent of (not in communication with) the inner space of the casing 20.

Figure 2:
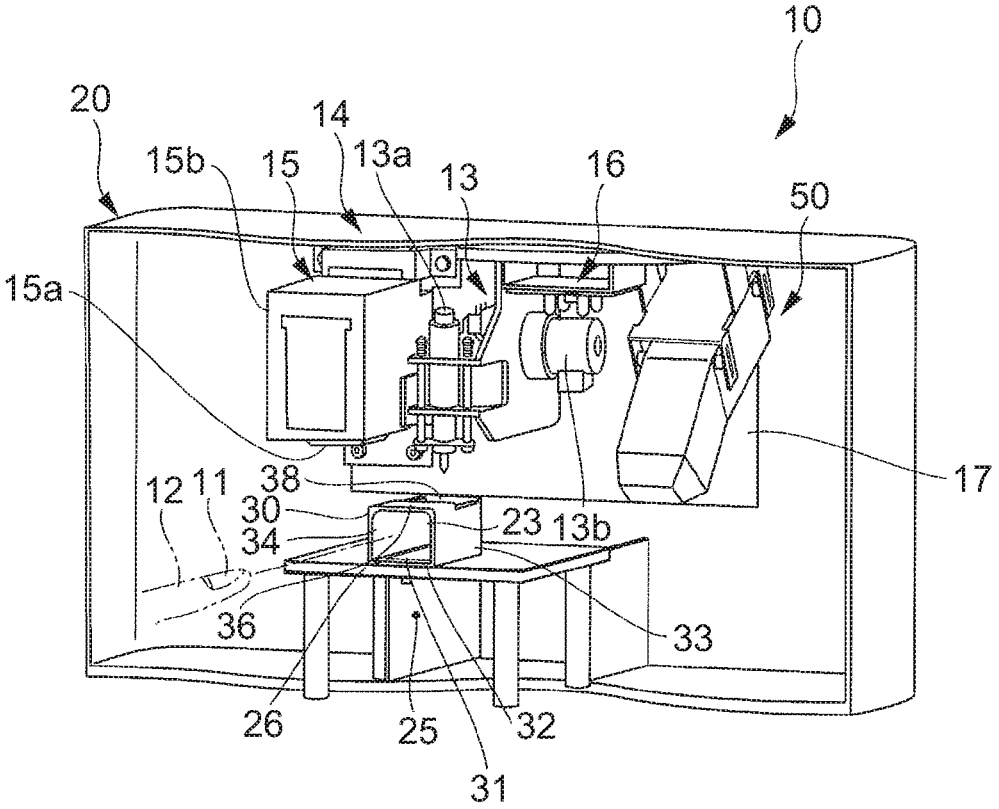
FIG. 2 is a perspective view with the casing of the drawing apparatus cut along the line A-A in FIG. 1.

FIG. 2 is a perspective view with the casing 20 of the drawing apparatus 10 cut along the line A-A in FIG. 1.

As shown in FIG. 2, a finger placing table 26 is provided at the lower part inside the casing 20, and a finger holding case 30 is provided on an upper surface (a placing surface 26*a*) of the finger placing table 26. The inner space of the finger holding case 30 is a space for forming the first finger insertion portion 23 (finger insertion portion). As described later, a finger pressing unit (first pressing unit) 31 is arranged in this space.

At the upper part inside the casing 20, a clamping plate 17 is provided in such a way as to be movable in the width direction and in the depth direction of the drawing apparatus 10.

In the clamping plate 17, a drawing unit 14 having a pen plotter unit 13 and an inkjet unit 15, an image acquiring unit 16, and a dryer 50 are secured and aligned in the width direction of the drawing apparatus 10.

Therefore, if the clamping plate 17 moves in the width direction and the depth direction of the drawing apparatus 10, the drawing unit 14 having the pen plotter unit 13 and the inkjet unit 15, the image acquiring unit 16, and the dryer 50 move in the width direction and the depth direction of the drawing apparatus 10 together with the clamping plate 17.

Incidentally, FIG. 2 shows the internal state of the drawing apparatus 10 in a situation where the pen plotter unit 13 is moved vertically upward with respect to an opening 38 of the finger holding case 30.

Note here that the pen plotter unit 13 is a portion used to apply a base coat, for example, on the surface of the nail 11 and has a pen 13*a* which performs drawing on the nail 11.

The pen plotter unit 13 is vertically movable in the up-and-down direction by driving means 13*b* such as a stepping motor.

Therefore, the pen plotter unit 13 is movable in the width direction, the depth direction, and the vertical direction of the drawing apparatus 10 as the aforementioned clamping plate 17 moves.

Thus, the pen plotter unit 13 moves to a position immediately above the opening 38 of the finger holding case 30 and thereafter is allowed to perform drawing on the surface of the nail 11 with the tip of the pen 13*a* lowered to come into contact with the surface of the nail 11.

The inkjet unit 15 is used to perform printing of a design onto the surface of the nail 11, for example.

The inkjet unit 15 includes an inkjet head 15*a* and an inkjet cartridge 15*b*.

The inkjet unit 15 moves to a position immediately above the opening 38 of the finger holding case 30 as the clamping plate 17 moves and then forms a desired design onto the surface of the nail 11 with the inkjet head 15*a*.

The image acquiring unit 16 includes a camera 16*a* for acquiring an image of the nail 11, for example, and a light source 16*c*. In addition, the image acquiring unit 16 also functions as a part of an inclined state detection unit which detects the inclined state in the width direction of the nail 11 by cooperating with an image analysis program.

The light source 16*c* has a function of emitting linear light (hereinafter, referred to as "line light"), for example, and radiates line light along the width direction of the nail 11.

The camera 16*a* images the nail 11 irradiated with line light by the light source 16*c* and the image acquiring unit 16 performs processing based on a light section method by using the image acquired thereby to acquire a curved shape in the width direction of the nail 11. The details will be described later.

The image acquired by the image acquiring unit 16 is also used to acquire information on where the nail 11 is located in the first finger insertion portion 23.

In this embodiment, pressure control of a finger pressing unit 31 described later is performed on the basis of a detection result of the inclined state of the nail 11 detected by the inclined state detection unit.

The dryer 50 dries ink applied to the nail 11 by blowing hot air. The dryer 50 is movable integrally with the clamping plate 17 as described above and moves to the position immediately above the opening 38 of the finger holding case 30 to blow air for drying toward the surface of the nail 11.

(Configuration of Finger Holding Case)

Figure 3:
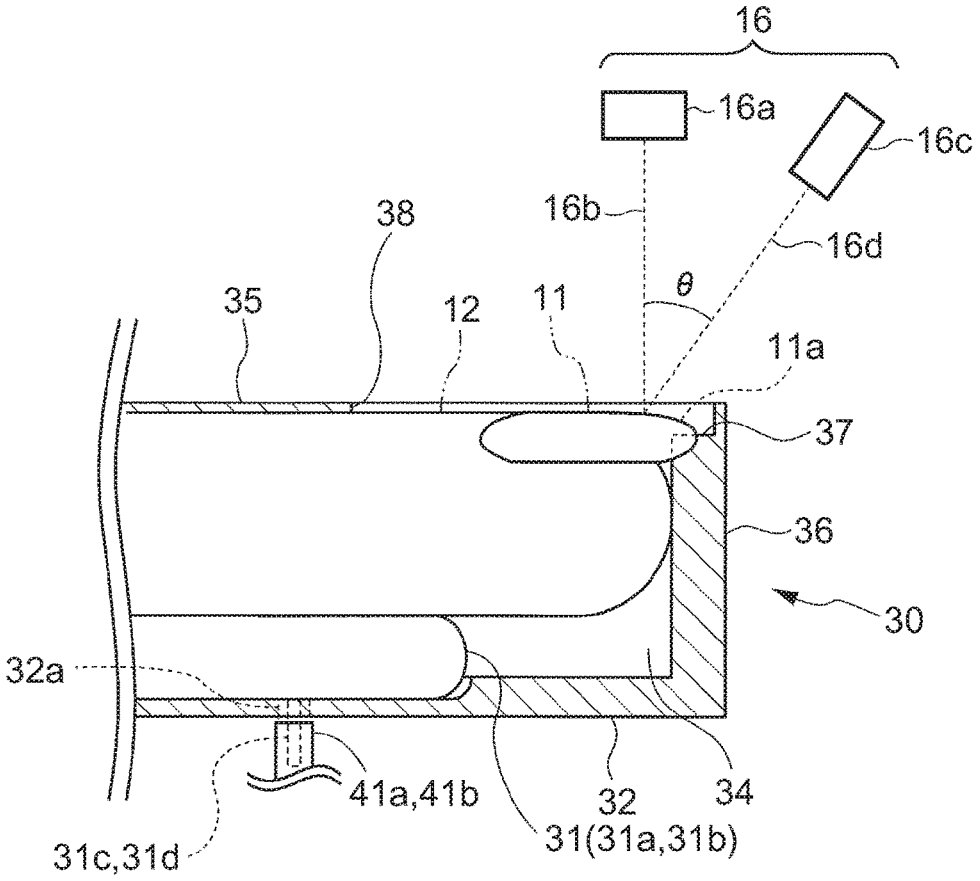
FIG. 3 is a sectional view cut along the inner surface of the right side wall of a first finger insertion portion viewed toward the left side wall.

FIG. 3 is a sectional view cut along the inner surface of the right side wall of the first finger insertion portion 23 viewed toward the left side wall.

The finger holding case 30 which forms the first finger insertion portion 23 has a cylindrical shape as a whole in such a way as to enclose the finger 12 with the tip of the finger 12 exposed as shown in FIG. 3.

Specifically, the finger holding case 30 is formed of a lower wall 32, right and left sidewalls 33 and 34 extending vertically upward from the right and left both ends of the lower wall 32, an upper wall 35 which couples the upper ends of the right and left sidewalls 33 and 34 with each other, and an inner wall 36 which couples the ends of the right and left sidewalls 33 and 34 located backward in the insertion direction of the finger 12.

Additionally, a nail placing portion 37 for use in placing the nail tip 11*a* of the nail 11 is provided at the upper end of the inner wall 36.

An opening 38 is formed between the upper wall 35 and the inner wall 36 so as to expose the nail 11 of the inserted finger 12 vertically upward.

Furthermore, the lower wall 32 has a through-hole 32*a* formed therein for supplying or discharging air to or from the finger pressing unit 31.

As shown in FIG. 3, the camera 16*a* of the image acquiring unit 16 is arranged so as to image the nail 11 from a direction where an optical axis 16*b* is substantially perpendicular to the placing surface 26*a*.

The light source 16*c* is arranged so as to irradiate the nail 11 with line light from diagonally above, where an optical axis 16*d* of the light source 16*c* is different from the optical axis 16*b* of the camera 16*a*.

Here, θ is assumed to be an angle between the optical axis 16*b* of the camera 16*a* and the optical axis 16*d* of the light source 16*c*. The camera 16*a* images the entire nail 11 and a part of the finger 12 including a line La formed on the nail 11 with the nail 11 illuminated with the line light.

Figure 4:
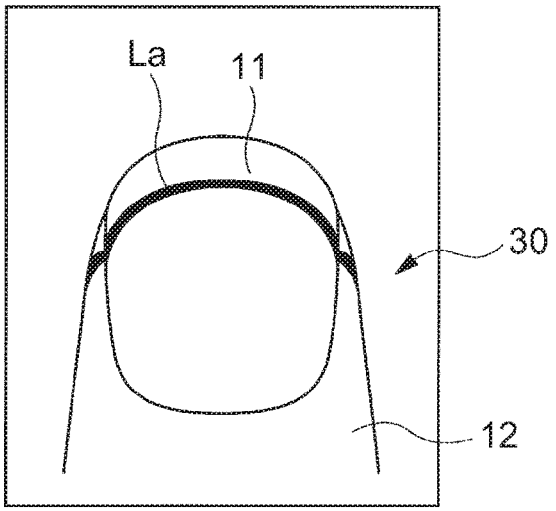
FIG. 4 is a diagram showing an example of an image acquired by taking an image of a nail by using a camera.

FIG. 4 shows an example of an image acquired by the camera 16*a*, where the line La of the line light is formed on the nail 11.

The image acquiring unit 16 calculates a curve (nail-shaped curve) Lb indicating the shape in the height direction of a part illuminated with the line light of the nail 11 as shown in FIG. 5 on the basis of the shape of the line La and the angle 0 between the optical axis 16*b* and the optical axis 16*d* in this image.

Figure 5A:
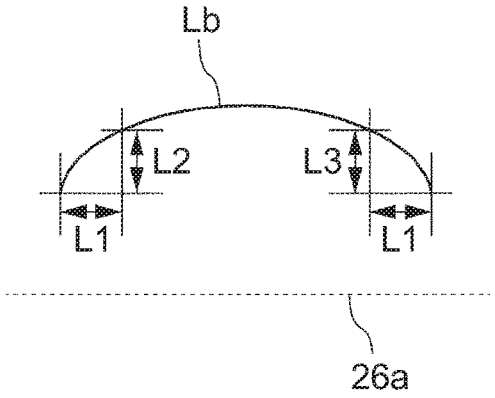
FIG. 5A shows a shape in the height direction of a part of the nail to which line light is applied in the case where the nail is placed in the horizontal state.
Figure 5B:
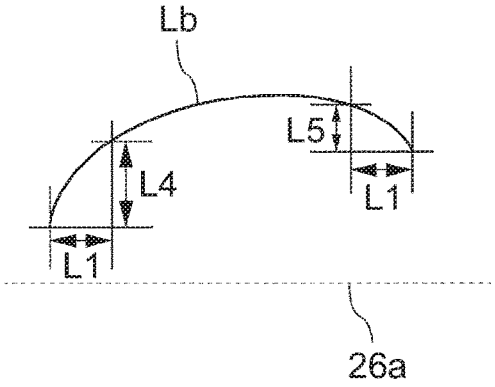
FIG. 5B shows a shape in the height direction of the nail in the case where the entire nail is inclined to the left.

Here, FIG. 5A shows a nail-shaped curve Lb not inclined since the nail 11 is placed in a horizontal state where the nail 11 is substantially parallel to the surface direction of the placing surface 26*a*. FIG. 5B shows a nail-shaped curve Lb in the case where the nail 11 is inclined to the left with respect to the surface direction of the placing surface 26*a*.

The image acquiring unit 16 as a curved state detection unit detects distances L2 to L5 in the height direction perpendicular to the surface direction of the placing surface 26*a* from the end of the nail-shaped curve Lb in parts inward from both ends of the nail-shaped curve Lb by a predetermined distance L1 along the surface direction of the placing surface 26*a*, for example, as shown in FIGS. 5A and 5B and detects the degree of right-side inclination in the width direction of the nail 11 and the degree of left-side inclination in the width direction of the nail 11 on the basis of the values of ratios between the distances L2 to L5 and the distance L1.

Figure 5C:
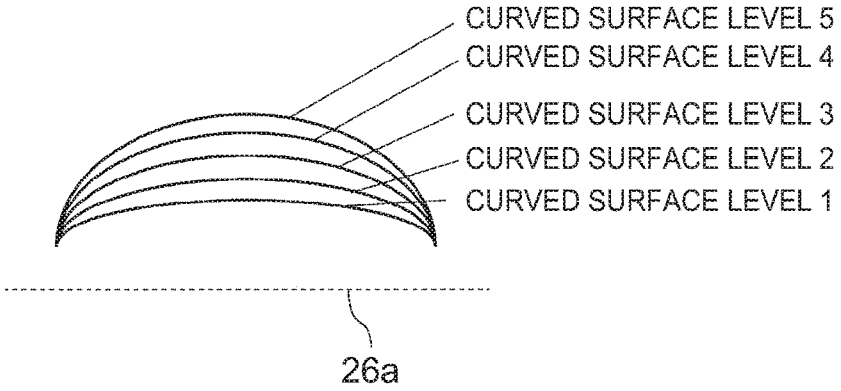
FIG. 5C shows an example of a plurality of reference curved surface levels different from each other in the degree of curve.

FIG. 5C shows an example of a plurality of reference curved surface levels (curved surface levels 1 to 5) different from each other in the degree of curve, which are stored as reference curved surface level information in a storage unit 61 described later.

The image acquiring unit 16 compares the values of L2/L1, L3/L1, L4/L1, and L5/L1 of the nail-shaped curve Lb, for example, with values corresponding to the curved surface levels 1 to 5, respectively, and acquires the nearest curved surface level among the curved surface levels 1 to 5.

(Configuration of Finger Pressing Unit)

Inside the finger holding case 30, the finger pressing unit 31 is provided.

The finger pressing unit 31 is a member for restricting the movement of the finger 12 between the upper wall 35 of the finger holding case 30 and the finger pressing unit 31.

In this embodiment, two (a plurality of) finger pressing units are provided as the finger pressing unit 31.

Figure 6:
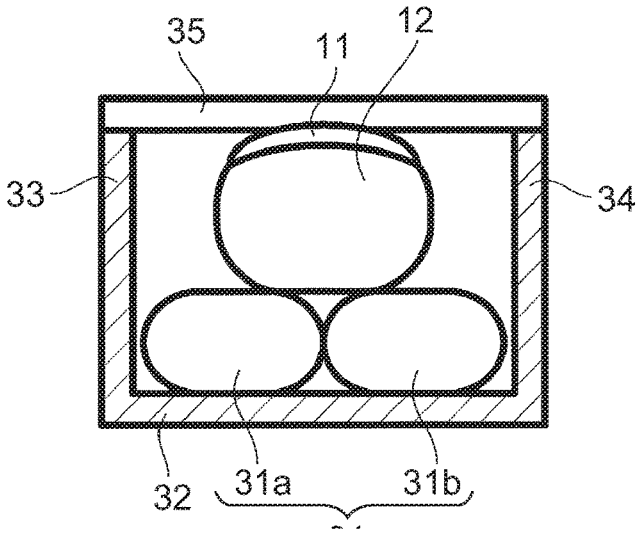
FIG. 6 is a sectional view cut along the inner surface of the inner wall of the first finger insertion portion viewed toward the insertion port.

More specifically, as shown in FIG. 6, the two finger pressing units are formed of two airbags 31*a* and 31*b* arranged in parallel in a direction perpendicular to the direction in which the finger 12 is inserted, specifically, in the width direction of the finger 12 and the nail 11 on the lower wall 32 of the finger holding case 30. In the following description, the finger pressing unit is simply referred to as "airbag" in some cases.

The airbags 31*a* and 31*b* are formed of bags inflated and deflated by supplying and discharging a fluid such as air and have widths almost equal to each other.

Furthermore, if the air is supplied to the inside of the airbags 31*a* and 31*b* and the inside pressure increases, the airbags 31*a* and 31*b* inflate and push up the ball of the finger 12. Thereby, air is discharged from the inside and the inside pressure decreases. Thereupon, the airbags 31*a* and 31*b* deflate and release the state in which the finger 12 is pushed up.

Therefore, if the finger 12 is properly inserted into the finger holding case 30 as shown in FIG. 6, for example, airbags 31*a* and 31*b* inflate and push up the ball of the finger 12. Thereupon, the back of the finger 12 comes in contact with the lower surface of the upper wall 35 and the position of the finger 12 in the finger holding case 30 is fixed with the nail 11 placed substantially in a horizontal state.

Figure 7A:
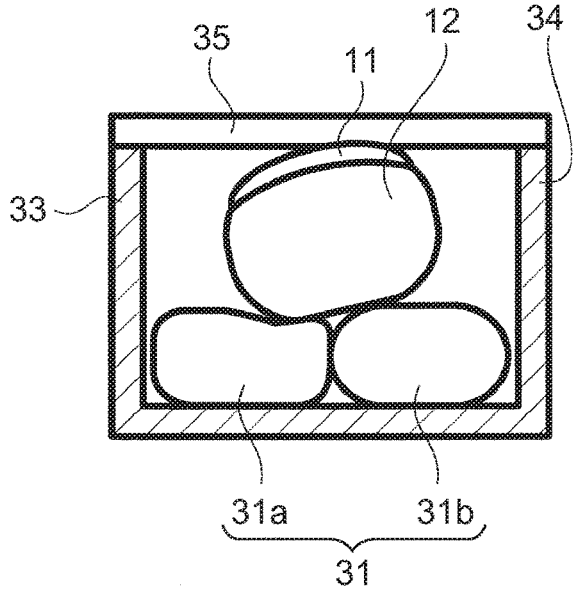
FIG. 7A is a diagram showing an example of a situation where the finger is held by the first finger insertion portion with the finger inclined toward the right side wall of the first finger insertion portion and FIG. 7B is a diagram showing an example of a state where the inclination of the finger is adjusted.

If the airbags 31*a* and 31*b*, however, inflate and push up the ball of the finger 12 in a state where the finger 12 inserted in the finger holding case 30 rotates to the left viewed from the fingertip side with the extending direction as a rotation axis and the nail 11 is inclined toward the right side wall 33 along the width direction as shown in FIG. 7A, for example, the nail 11 is inclined toward the right side wall 33.

In this state, when the pen plotter unit 13 and the inkjet unit 15 of the drawing unit 14 are to form a design picture on the nail 11 from vertically above, the end of the nail 11 on the side of the right side wall 33 is a blind spot for the drawing unit 14, for example, thereby generating a portion where drawing cannot be performed on one end side in the width direction of the nail 11 or generating a portion where the design picture is distorted and cannot be normally and beautifully formed on the nail 11.

Figure 7B:
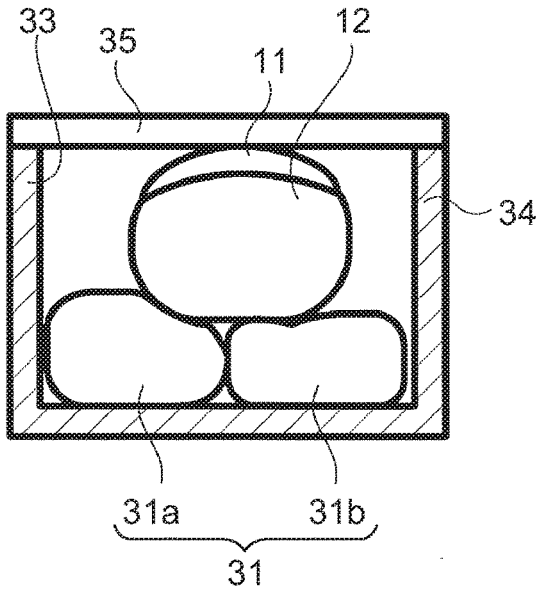

Therefore, in such a case, the airbag 31*a* on the side of the right side wall 33 is inflated to a size larger than the airbag 31*b* on the side of the left side wall 34 as shown in FIG. 7B. Thereby, the finger 12 is inclined toward the left side wall 34, by which the inside pressure of the airbag 31*a* and that of the airbag 31*b* are adjusted so that the nail 11 is placed substantially in the horizontal state.

Thereby, the nail 11 is placed in a state where drawing is able to be normally performed on both end sides in the width direction of the nail 11.

Figure 8A:
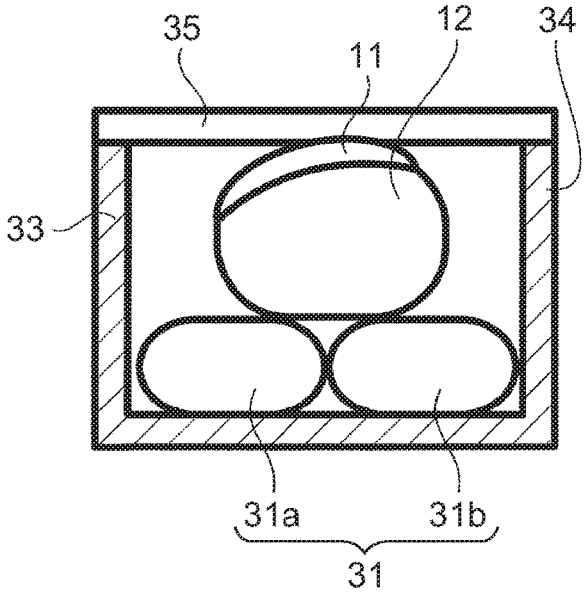
FIG. 8A is a diagram showing an example of a situation where the finger having a nail inclined toward the right side wall of the first finger insertion portion is held by the first finger insertion portion and FIG. 8B is a diagram showing an example of a state where the inclination of the nail is adjusted.

Also in the case where the nail 11 is inclined toward the right side wall 33 with respect to the finger 12 as shown in FIG. 8A, for example, the end of the nail 11 on the side of the right side wall 33 is a blind spot for the pen plotter unit 13 and the inkjet unit 15 of the drawing unit 14, thereby generating a portion where drawing cannot be performed on the other end side in the width direction of the nail 11 or generating a portion where the design picture is distorted and cannot be normally and beautifully formed on the nail 11.

Figure 8B:
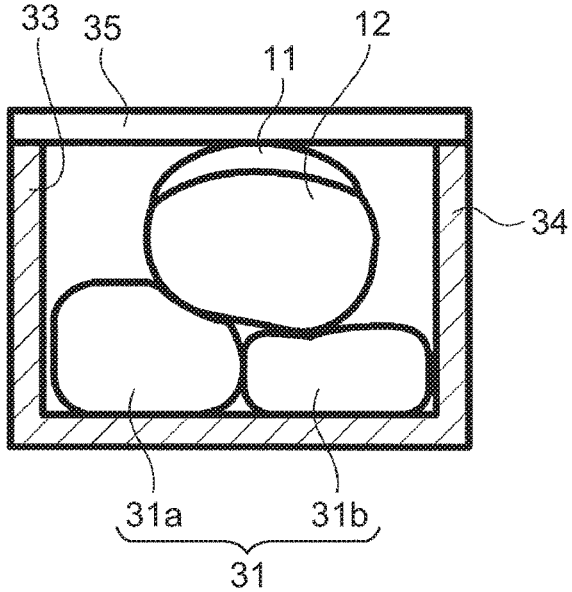

Therefore, the airbag 31*a* on the side of the right side wall 33 is inflated to a size larger than the airbag 31*b* on the side of the left side wall 34 as shown in FIG. 8B, by which the inside pressure of the airbag 31*a* and that of the airbag 31*b* are adjusted so that the nail 11 is placed substantially in the horizontal state similarly to the above. Thereby, the nail 11 is placed in a state where drawing is able to be normally performed on both end sides in the width direction of the nail 11.

In this manner, correcting the inclined state of the nail 11 to the horizontal state enables a design picture to be properly formed on the nail 11.

The inside pressures and the like of the drawing unit 14, the image acquiring unit 16, the dryer 50, and the airbags 31*a* and 31*b* are controlled via the control unit 60. The control unit 60 is provided in the casing 20.

Figure 9:
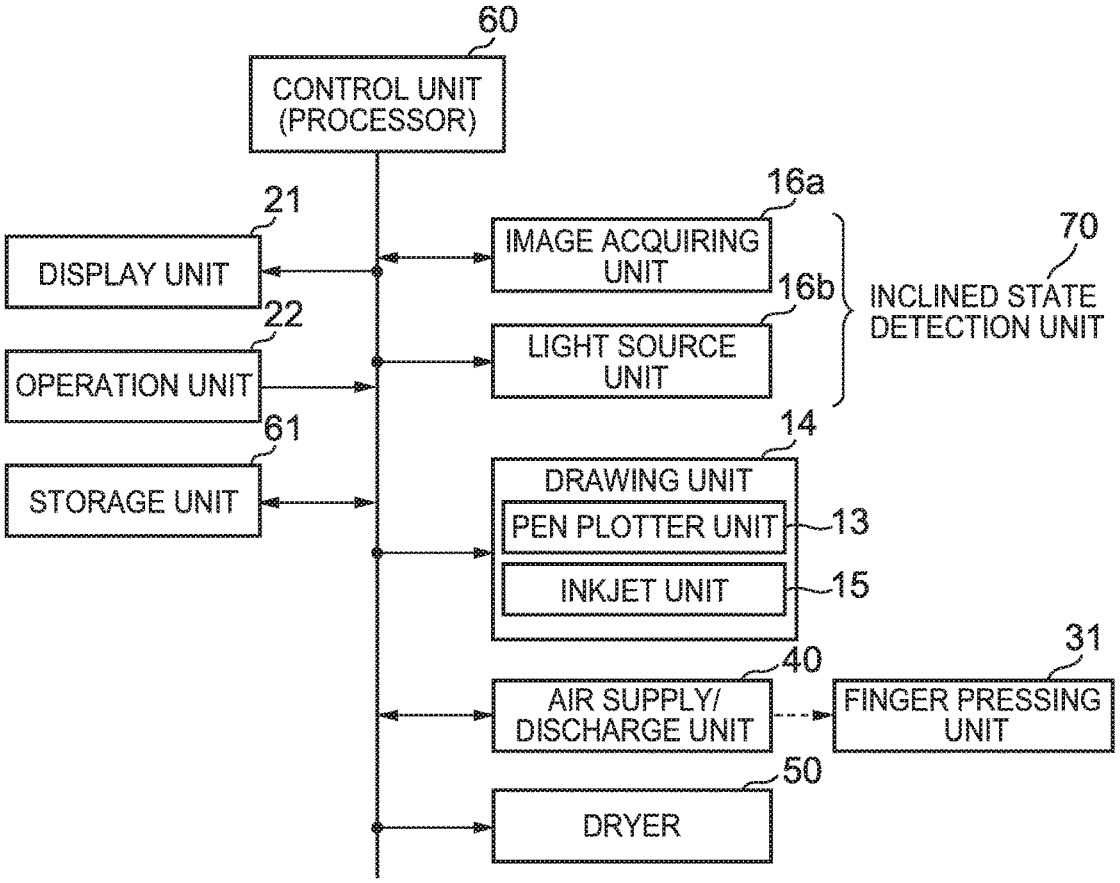
FIG. 9 is a main part block diagram showing the control configuration of the drawing apparatus.

FIG. 9 is a main part block diagram showing the control configuration of the drawing apparatus 10.

As shown in FIG. 9, the drawing apparatus 10 includes the aforementioned drawing unit 14 having the pen plotter unit 13 and the inkjet unit 15, the image acquiring unit 16 including the camera 16*a* and the light source 16*c*, a light source unit 16*b* for emitting line light, an air supply/discharge unit 40 described later for controlling the finger pressing unit 31, the display unit 21 including a liquid crystal display monitor and the like, the operation unit 22, and the dryer 50, and further includes a storage unit 61 for storing processing programs and information on a plurality of reference curved surface levels and a control unit (processor) 60 including a CPU and the like for controlling various operations on the basis of the processing programs, where they are connected to each other via a bus.

The storage unit 61 is configured to have a read only memory (ROM), a flash memory, and the like, for example. The storage unit 61 has a program area for storing a processing program for implementing various functions of the drawing apparatus 10, a data area for storing reference curved surface level information having a plurality of reference curved surface levels different from each other in the degree of curve or the like, and a work area for temporarily storing work data or the like generated in the process of forming a nail design, which are allocated to the storage unit 61.

(Configuration of Air Supply/Discharge Unit)

The air supply/discharge unit 40 is a mechanism for supplying air to the airbags 31*a* and 31*b* constituting the finger pressing unit 31 by the control of the control unit 60 and for discharging air from the airbags 31*a* and 31*b*.

As shown in FIG. 3, the air supply/discharge unit 40 is connected to air supply/discharge ports 31*c* and 31*d* of the airbags 31*a* and 31*b* projecting to the outside of the finger holding case 30 passing through the through-hole 32*a* via tubes 41*a* and 41*b*.

Figure 10:
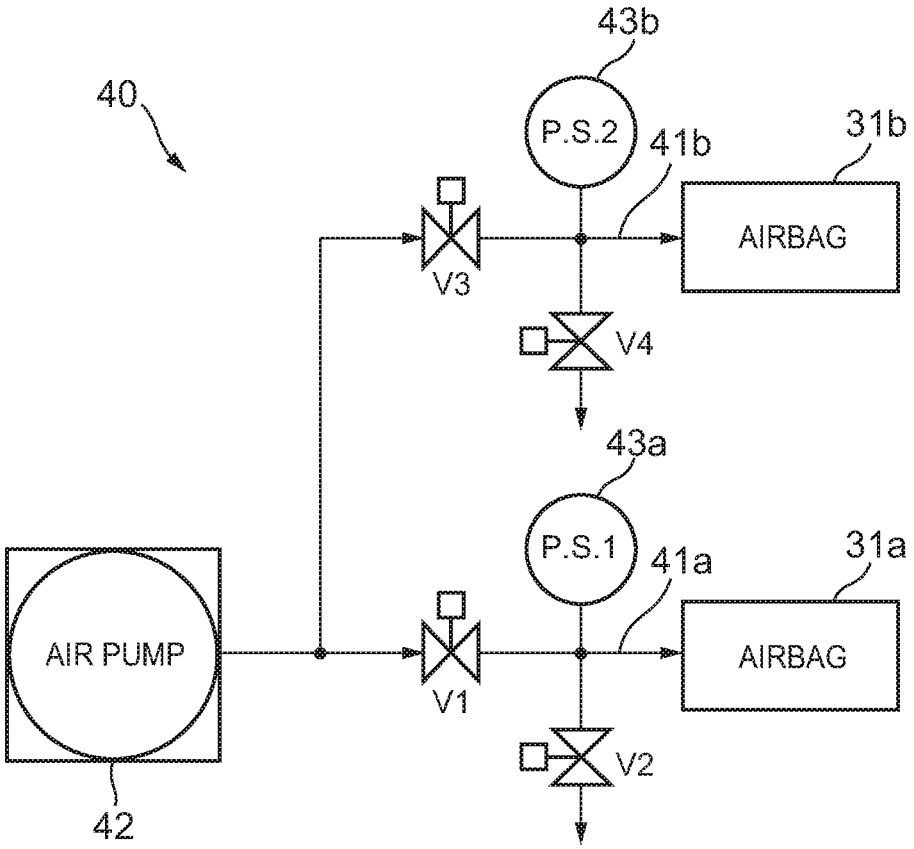
FIG. 10 is a block diagram showing an example of an air supply/discharge unit.

FIG. 10 is a block diagram showing an example of the air supply/discharge unit.

As shown in FIG. 10, the air supply/discharge unit 40 includes an air pump 42 which supplies air to the airbags 31*a* and 31*b* via the tubes 41*a* and 41*b*, pressure sensors 43*a* and 43*b* which measure the inside pressures of the airbags 31*a* and 31*b*, valves V1 and V2 for opening or closing flow paths in the tube 41*a* and valves V3 and V4 for opening or closing flow paths in the tube 41*b*.

The valves V1 to V4 are solenoid valves, for example.

The valves V1 and V3 adjust the amount of air supplied from the air pump 42 to the airbags 31*a* and 31*b*, and the valves V2 and V4 adjust the amount of air discharged from the airbags 31*a* and 31*b* so that measurement results of the pressure sensors 43*a* and 43*b* show the target values set in a procedure described later.

In the air supply/discharge unit 40, the valves V2 and V4 are closed so as to prevent air in the finger pressing unit 31 (the airbags 31*a* and 31*b*) from being discharged, first, in a state where the finger 12 is inserted into the first finger insertion portion 23 and the nail tip 11*a* is placed in the nail placing portion 37.

Subsequently, the valves V1 and V3 are opened and then air is pumped from the air pump 42 to the airbags 31*a* and 31*b* through the tubes 41*a* and 41*b*.

In addition, the pressure sensors 43*a* and 43*b* measure the pressure and the air pump 42 and the valves V1 and V3 are adjusted according to the measurement results, by which almost constant pressure is applied to the inside air of the airbags 31*a* and 31*b*.

Thereby, as shown in FIG. 6, the finger pressing unit 31 (the airbags 31*a* and 31*b*) presses the finger 12 to the upper wall 35 by pushing up the ball of the finger 12 so as to restrict the movement of the finger 12.

Incidentally, if it is detected that the nail 11 is inclined as shown in FIGS. 7A and 8A in a state where the movement of the finger 12 is restricted with the finger 12 pushed to the upper wall 35 by pushing up the ball of the finger 12 as described above, for example, the airbag 31*a* is inflated to a size larger than the airbag 31*b* to obtain the state as shown in FIGS. 7B and 8B, thereby enabling the nail 11 to be placed substantially in the horizontal state.

Specifically, the valve V1 is opened with the valve V3 closed so as to supply air from the air pump 42 only to the airbag 31*a* and to inflate the airbag 31*a* to a size larger than the airbag 31*b*.

The nail 11 can be placed in the state as shown in FIGS. 7B and 8B by deflating the airbag 31*b* to a size smaller than the airbag 31*a* and thereby the right and left curved state of the nail 11 can get equal to each other.

In this case, the air in the airbag 31*b* is discharged by opening the valve V4 with the valve V2 closed.

Specifically, to achieve the states of FIGS. 5B and 6B from the states of FIGS. 5A and 6A, the airbag 31*a* only needs to be placed in an inflated state relatively larger than the size of the airbag 31*b*, and therefore it is only necessary to perform one or both of an operation of inflating the airbag 31*a* and an operation of deflating the airbag 31*b*.

After the nail 11 is placed substantially in the horizontal state as described above, a design picture is formed (by drawing a design, drying ink, and the like) on the nail 11. After the completion of the design formation, the finger 12 is taken out of the first finger insertion portion 23 and then the next finger 12 is inserted therein.

When taking the finger 12 out of the first finger insertion portion 23, the valves V2 and V4 are opened to discharge air from the airbags 31*a* and 31*b*, thereby releasing the finger 12 from the pressing thereon and releasing the finger 12 from the restriction on the movement thereof.

(Procedure for Adjusting Inclination of Nail)

Figure 11:
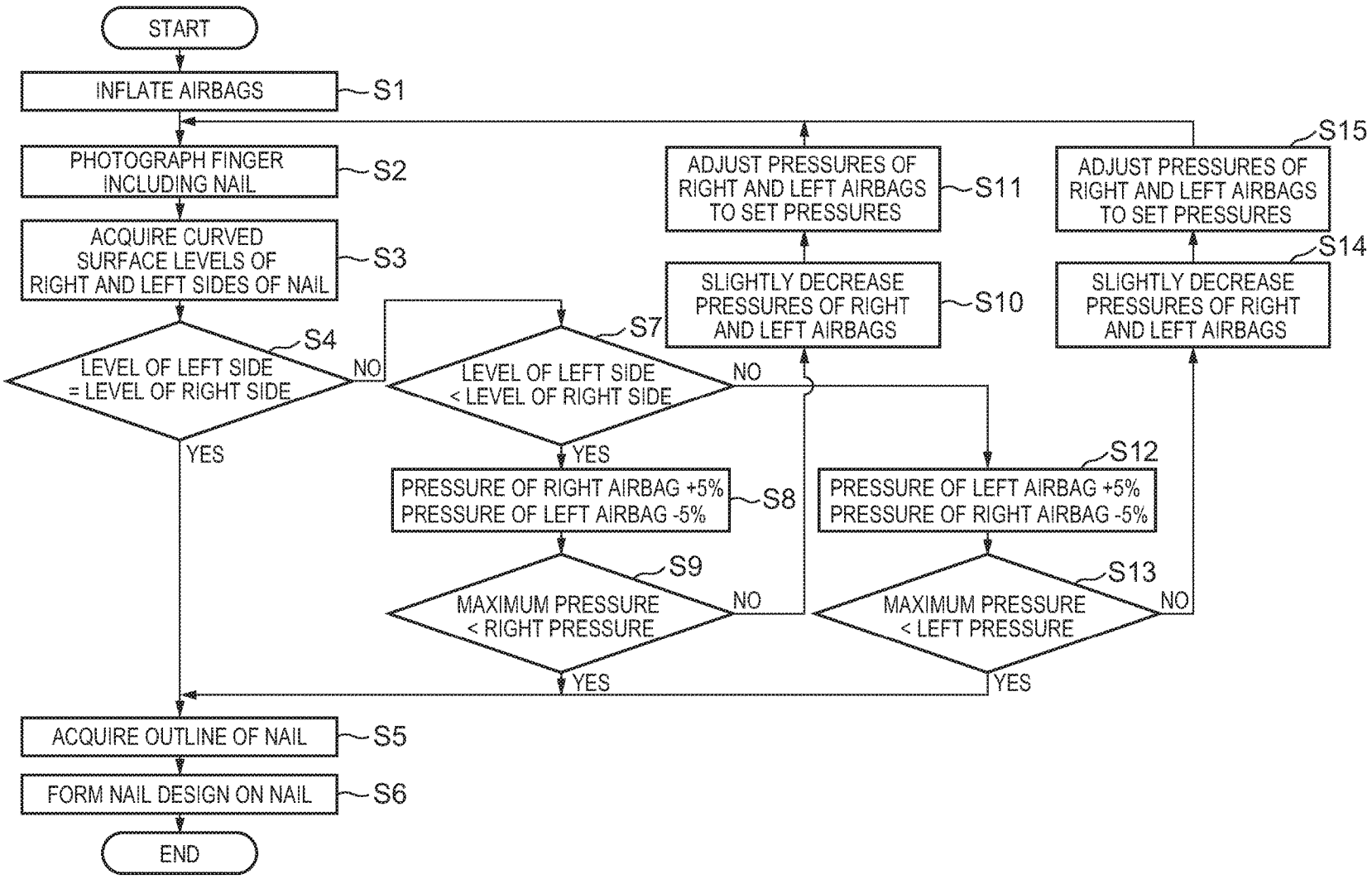
FIG. 11 is a flowchart showing an example of a procedure for adjusting the inclination of a nail.

The following describes the details of the procedure for adjusting the inclination of the nail 11 in the drawing apparatus 10 having the aforementioned device configuration with reference to FIG. 11.

FIG. 11 is a flowchart showing an example of a procedure for adjusting the inclination of the nail 11.

The procedure described below is performed every time the finger 12 is inserted.

First, the finger 12 is inserted into the first finger insertion portion 23 and the nail tip 11*a* is placed on the nail placing portion 37. Thereupon, the valves V1 and V3 are opened and the valves V2 and V4 are closed in step S1 and air is supplied from the air pump 42 to the airbags 31*a* and 31*b*, by which the airbags 31*a* and 31*b* are inflated.

Then, when the airbags 31*a* and 31*b* are inflated almost equally as shown in FIG. 6, the valves V1 and V3 are closed.

Subsequently, in step S2, the nail 11 is irradiated with line light from the light source 16*c* and the image acquiring unit 16 images the finger 12 including the nail 11 irradiated with line light to acquire the image as shown in FIG. 4.

Then, in step S3, the image is analyzed and a nail-shaped curve Lb as shown in FIGS. 5A and 5B is calculated.

In this image analysis, the position of the nail 11 and the degrees of inclination on the right and left sides of the nail 11 are acquired as described above.

In this embodiment, the nearest curved surface level among the plurality of reference curved surface levels (curved surface levels 1 to 5) is acquired with respect to each of the degrees of right-side inclination and left-side inclination in the width direction of the nail 11 by comparing the degrees of right-side inclination and left-side inclination in the width direction of the nail 11 with the plurality of reference curved surface levels different from each other in the degree of curve, which are previously stored as reference curved surface level information in the storage unit 61.

In step S4, it is determined whether or not the curved surface level acquired as described above is equal between the right and left sides of the nail 11.

If the curved surface level on the right side of the nail 11 is equal to the curved surface level on the left side of the nail 11, it is determined that the curved state of the nail 11 on the right side is almost the same as that on the left side and then the processing proceeds to step S5.

In step S5, the outline of the nail 11 is acquired. Furthermore, in step S6, the design picture is formed on the nail 11 on the basis of the information on the curved state and outline of the nail 11, by which the series of steps complete.

On the other hand, if it is determined that the curved surface level of the nail 11 on the left side is different from that on the right side in step S4, the processing proceeds to step S7.

In step S7, the curved surface level of the nail 11 on the left side is compared with that on the right side.

If it is determined that the curved surface level of the nail 11 on the left side is lower than that on the right side, the operations of the air pump 42 and the valves V1 to V4 are set so that the internal pressure of the airbag 31*a* on the side of the right side wall 33 increases by a predetermined value and the internal pressure of the airbag 31*b* on the side of the left side wall 34 decreases by a predetermined value in step S8.

Here, the predetermined value is able to be set to an arbitrary value. In this embodiment, the value is set to 5%, for example.

The predetermined value does not need to be given by a relative percentage to the initial pressure (the internal pressure of the airbag 31*a* or 31*b* after step S1) and may be given by an absolute value such as, for example, 0.5 kPa.

The predetermined value may be set in such a way as to be varied according to whether the pressure is increased or decreased.

Then, in step S9, it is determined whether or not the internal pressure of the airbag 31*a* on the side of the right side wall 33 exceeds a predetermined maximum value when the internal pressure of the airbag 31*a* is increased by 5% before changing the internal pressures of the airbags 31*a* and 31*b* as a practical manner.

If it is determined that the internal pressure of the airbag 31*a* on the side of the right side wall 33 exceeds the predetermined maximum value when the internal pressure of the airbag 31*a* is increased by 5% in the determination of step S9, the processing proceeds to step S5 without changing the internal pressures of the airbags 31*a* and 31*b* and then the processing proceeds to step S6.

Specifically, the design picture is formed on the nail 11 without increasing the internal pressure of the airbag 31*a* in order to protect the airbag 31*a* from excess internal pressure exceeding an allowable limit. In this situation, the internal pressure of the other airbag 31*b* is not decreased.

On the other hand, if it is not determined that the internal pressure exceeds the predetermined maximum value even after the internal pressure of the airbag 31*a* on the side of the right side wall 33 is increased by 5% in step S9, the processing proceeds to step S10, in which the internal pressures of the airbags 31*a* and 31*b* are decreased temporarily to reduce the upward forces of the airbags 31*a* and 31*b* for pushing up the finger 12. Thereafter, the processing proceeds to step S11, in which the air supply/discharge unit 40 operates so that the internal pressures of the airbags 31*a* and 31*b* are adjusted to the pressures set in step S8.

In the above, the temporary reduction in the upward forces of the airbags 31*a* and 31*b* in step S10 is intended to facilitate a change in inclination of the finger 12. This step S10 is provided only to decrease the pressure instantaneously. Immediately after the processing of step S10, processing of step S11 is performed.

Then, after the processing of step S11 is performed, the processing returns to step S2, in which the curved surface levels on the right and left sides in the width direction of the nail 11 are checked again.

If it is determined that the curved surface level on the left side of the nail 11 is higher than the curved surface level on the right side of the nail 11 in step S7, the processing proceeds to step S12.

In step S12, the operations of the air pump 42 and the valves V1 to V4 are set so that the internal pressure of the airbag 31*b* on the side of the left side wall 34 is increased by 5% and the internal pressure of the airbag 31*a* on the side of the right side wall 33 is decreased by 5%.

Then, in step S13, the relationship with the maximum pressure is checked similarly to step S9. Specifically, it is determined whether or not the internal pressure of the airbag 31*b* on the side of the left side wall 34 exceeds a predetermined maximum value if the internal pressure of the airbag 31*b* increases by 5%.

If it is determined that the internal pressure of the airbag 31*b* on the side of the left side wall 34 exceeds the predetermined maximum value when the internal pressure of the airbag 31*b* is increased by 5% in step S13, the processing proceeds to step S5 without increasing the internal pressure of the airbag 31*b* to protect the airbag 31*b* from excess internal pressure.

Then, the processing proceeds to step S6, in which a design picture is formed. In this situation, the internal pressure of the other airbag 31*a* is not decreased.

On the other hand, if it is not determined that the internal pressure of the airbag 31*b* on the side of the left side wall 34 exceeds the predetermined maximum value even after the internal pressure of the airbag 31*b* is increased by 5% in step S13, the processing proceeds to step S14, in which the internal pressures of the airbags 31*a* and 31*b* are decreased temporarily to reduce the upward forces of the airbags 31*a* and 31*b* for pushing up the finger 12.

Thereafter, in step S15, the operation of the air supply/discharge unit 40 is performed so that the internal pressures of the airbags 31*a* and 31*b* are adjusted to the pressures set in step S12.

Incidentally, slightly decreasing the internal pressures of the airbags 31*a* and 31*b* instantaneously also in step S14 similarly to step S10 is intended to facilitate the change in the inclination of the finger 12. Then, after the processing of step S14 is performed, the processing returns to step S2, in which the curved surface levels on the right and left sides in the width direction of the nail 11 are checked again.

The state of the finger 12 pushed up by the plurality of airbags 31*a* and 31*b* is adjusted as described above, thereby adjusting the curved surface level of the nail 11 on the right side and that on the left side as in the states of FIGS. 7A and 8A, for example.

If the nail 11 is placed substantially in the horizontal state with the curved surface level on the right side in the width direction of the nail 11 is equal to that on the left side as shown in FIGS. 7B and 8B, the determination result of step S4 is affirmative (YES) and the steps S5 and S6 are performed, by which the series of processes complete.

[Variation 1]

Figure 12A:
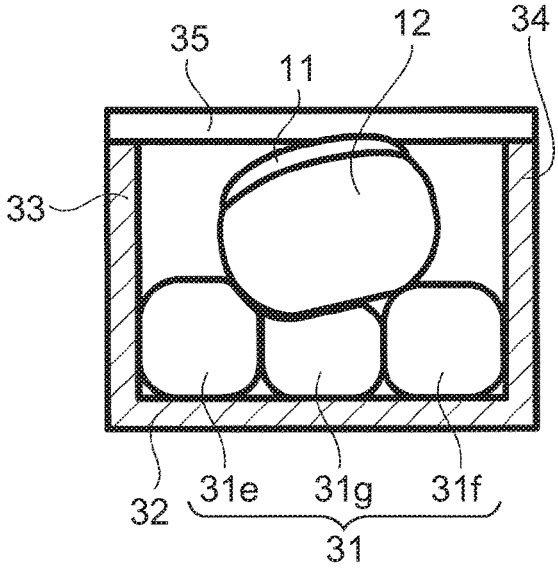
FIGS. 12A and 12B are sectional views similar to FIG. 6, each showing the structure of the first finger insertion portion in example 1.
Figure 12B:
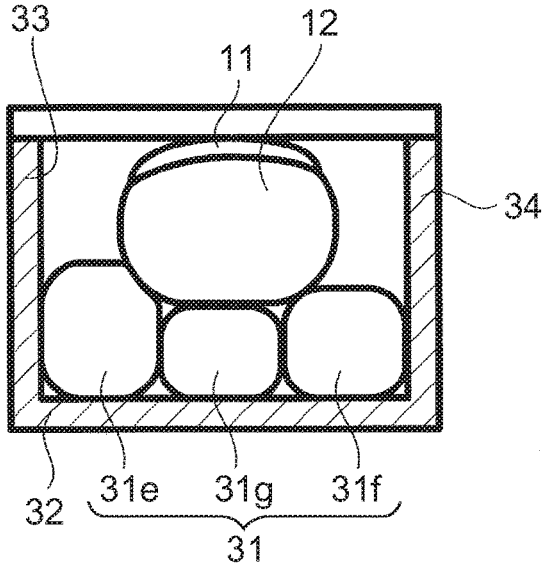

The following describes variation 1 of this embodiment with reference to FIG. 12.

FIG. 12 is a sectional view, which is similar to FIG. 6, showing the structure of a first finger insertion portion in variation 1.

The basic configuration of a drawing apparatus according to variation 1 is the same as the basic configuration of the drawing apparatus 10 according to the present embodiment.

The drawing apparatus according to variation 1 differs from the drawing apparatus 10 according to the present embodiment in that three airbags constitute a finger pressing unit 31.

Specifically, the finger pressing unit 31 according to variation 1 includes an airbag 31*e* on the side of the right side wall 33, an airbag 31*f* on the side of the left side wall 34, and an airbag 31*g* in the center located between the airbags 31*e* and 31*f* as shown in FIG. 12.

The airbag 31*e* on the side of the right side wall 33 and the airbag 31*f* on the side of the left side wall 34 are bags having substantially the same width.

The airbag 31*g* is a bag similar to the airbags 31*e* and 31*f*, too.

The width of the airbag 31*g* may be the same as the width of the airbag 31*e* and that of the airbag 31*f* or may be different from these widths. Preferably the width of the airbag 31*g* is smaller than the width of the finger 12 as shown in FIG. 12.

In variation 1, the internal pressure of the airbag 31*e* on the side of the right side wall 33 and that of the airbag 31*f* on the side of the left side wall 34 are adjusted according to the degree of inclination of the curved surface of the nail 11.

The airbag 31*e* on the side of the right side wall 33 and the airbag 31*f* on the side of the left side wall 34 are adjusted in the same procedure as in FIG. 11.

The center airbag 31*g* is adjusted only for whether or not the airbag 31*g* is inflated to a predetermined size.

Accordingly, the center airbag 31*g* has a role in pressing the finger 12 against the upper wall 35 of the finger holding case 30, and the airbag 31*e* on the side of the right side wall 33 and the airbag 31*f* on the side of the left side wall 34 have a role in inclining the finger 12 toward one of the right and left sides so that the curved states on both sides of the finger 11 are substantially equal to each other.

In this variation 1, there are added a tube for connecting the air pump 42 to the center airbag 31*g*, a valve for opening and closing an air flow path in the tube, and a pressure sensor for measuring the internal pressure of the airbag 31*g* as components of the air supply/discharge unit 40.

In variation 1 as described above, the inclination of the nail 11 can be changed by the right and left airbags 31*e* and 31*f* with the finger 12 reliably pressed against the upper wall 35 of the finger holding case 30 by the center airbag 31*g*.

[Variation 2]

Figure 13:
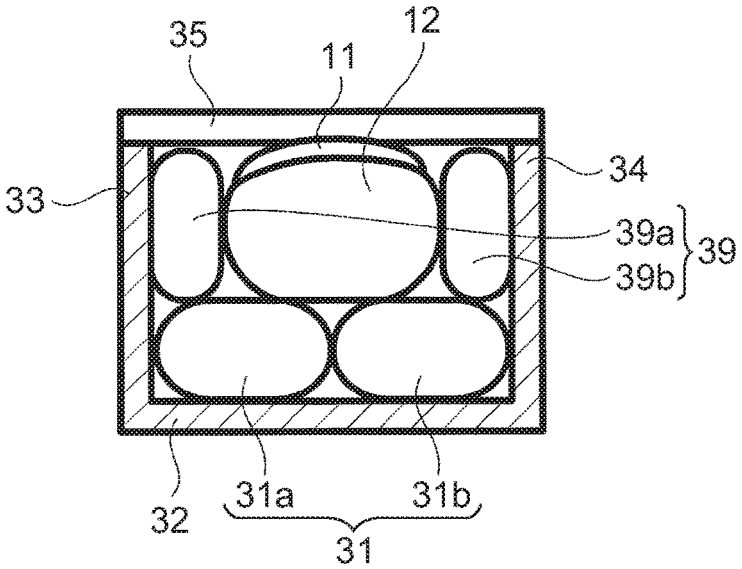
FIG. 13 is a sectional view similar to FIG. 6, showing the structure of the first finger insertion portion in variation 2.

Referring to FIG. 13, variation 2 will be described below.

FIG. 13 is a sectional view similar to FIG. 6, showing the structure of the first finger insertion portion in variation 2.

The drawing apparatus according to variation 2 includes the configuration of the drawing apparatus 10 according to the present embodiment and further includes a pair of side airbags 39*a* and 39*b* constituting a finger pressing unit 39 (a second pressing unit).

The side airbags 39*a* and 39*b*, which are provided on the inner surfaces of the sidewalls 33 and 34 on the right and left sides of the finger holding case 30 respectively, inflate to press the right and left sides of the tip of the finger 12.

The side airbags 39*a* and 39*b*, which are bags similarly to the airbags 31*a* and 31*b*, inflate or deflate by supplying or discharging a fluid such as air.

The pair of side airbags 39*a* and 39*b* press the finger 12 from the right and left sides thereof, thereby enabling the finger 12 to be restricted from moving in the width direction of the finger holding case 30. Therefore, the finger 12 is positioned at an appropriate position in the finger holding case 30, thereby enabling the formation of a beautiful design picture.

As a mechanism for supplying or discharging air to or from the side airbags 39*a* and 39*b*, a device similar to the air supply/discharge unit 40 as shown in FIG. 10, for example, may be separately provided, or an additional flow path (a tube, a valve, and a pressure sensor) may be provided so that air is also supplied from the air pump 42 of the air supply/discharge unit 40 to the side airbags 39*a* and 39*b*.

There are various procedures for adjusting the internal pressures of the pair of side airbags 39*a* and 39*b*. When the airbags 31*a* and 31*b* are inflated in step S1 of FIG. 11, for example, the pair of side airbags 39*a* and 39*b* may be inflated together.

In this case, when the internal pressures of the airbags 31*a* and 31*b* are temporarily decreased in steps S10 and S14, the internal pressures of the pair of side airbags 39*a* and 39*b* may be temporarily decreased, too.

In addition, when the internal pressure of one of the airbags 31*a* and 31*b* is increased, preferably the internal pressures of the side airbags 39*a* and 39*b* are adjusted for ease of inclination of the nail 11.

Specifically, when the airbag 31*a* is inflated to push up the right side of the finger 12 in step S11 of FIG. 11, the inflating level of the side airbag 39*b* located on the left side of the finger 12 is adjusted so as to be lower than the side airbag 39*a* located on the right side of the finger 12 to reduce the pressing force for pressing the left side of the finger 12 more than that for pressing the right side of the finger 12 for ease of inclination of the nail 11 toward the left side.

Contrarily, when the airbag 31*b* is inflated to push up the left side of the finger 12 in step S15 of FIG. 11, the inflating level of the side airbag 39*a* located on the right side of the finger 12 is adjusted so as to be lower than the side airbag 39*b* located on the left side of the finger 12 to reduce the pressing force for pressing the right side of the finger 12 more than that for pressing the left side of the finger 12 for ease of inclination of the nail 11 toward the right side.

Specifically, when pushing up one of the right and left sides of the finger 12 by using the finger pressing unit 31 (the airbag 31*a* or 31*b*) corresponding to one of the right and left sides of the finger 12, the finger pressing unit 39 (the side airbags 39*a* and 39*b*) reduces the pressing force for pressing the finger 12 applied by the finger pressing unit 39 (the side airbag 39*a* or 39*b*) located on the other of the right and left sides of the finger 12 so as to be lower than one of the right and left sides.

Although the preferred embodiments of the present invention have been described in detail hereinabove, it should be understood that the present invention is not limited to the above embodiments and various changes and modifications can be made within the spirit and scope of the present invention as defined by the following claims.

The finger pressing unit of variation 2, for example, may be a finger pressing unit including three airbags as described in variation 1.

What is claimed is:

1. A drawing apparatus comprising:

an object insertion portion into which an object is inserted, the object being at least one finger or toe having a nail;

a plurality of first pressing units which apply pressing forces to the object inserted in the object insertion portion to hold the object in the object insertion portion; and a processor which controls the pressing forces applied by the plurality of first pressing units respectively to adjust an inclination in a width direction of the nail of the object inserted in the object insertion portion.

2. The drawing apparatus according to claim 1, wherein each of the plurality of first pressing units is provided side by side in a direction intersecting a direction in which the object is inserted into the object insertion portion.

3. The drawing apparatus according to claim 1, further comprising a placing surface whose surface direction is set to a constant direction and the object insertion portion provided on the placing surface, wherein the processor controls the pressing forces applied to the object by the plurality of first pressing units respectively so that the degree of inclination on one side in the width direct of the nail with respect to the surface direction of the placing surface comes close to the degree of inclination on the other side in the width direction of the nail with respect to the surface direction of the placing surface.

4. The drawing apparatus according to claim 1, further comprising a drawing unit which performs a drawing on the nail, wherein the processor controls the pressing forces applied to the object by the plurality of first pressing units respectively so as to bring the inclined state in the width direction of the nail close to the state in which the drawing unit is able to perform the drawing normally on both end sides in the width direction of the nail when the inclined state in the width direction of the nail is a state where the drawing unit is not able to perform the drawing normally on either one of the both end sides in the width direction of the nail.

5. The drawing apparatus according to claim 4, wherein:

the inclined state detection unit detects a first degree of inclination on one end side in the width direction of the nail and a second degree of inclination on the other end side in the width direction of the nail; and the processor controls the pressing forces applied to the object by the plurality of first pressing units respectively in directions that cause the first degree of inclination and the second degree of inclination to be equal to each other in the case where the first degree of inclination and the second degree of inclination are not equal to each other.

6. The drawing apparatus according to claim 5, wherein the processor controls the pressing forces applied to the object by the plurality of first pressing units respectively in directions that cause the first degree of inclination and the second degree of inclination to be equal to each other after performing an operation of temporarily reducing the pressing forces applied to a surface on the side opposite to the nail of the object by all of the plurality of first pressing units in the case where the first degree of inclination and the second degree of inclination are not equal to each other.

7. The drawing apparatus according to claim 5, wherein:

the processor acquires the nearest curved surface level among the plurality of curved surface levels different from each other in a preset degree of curve corresponding to each of the first degree of inclination and the second degree of inclination; and the processor controls the pressing forces applied to the object by the plurality of first pressing units respectively so that any one of the plurality of curved surface levels corresponding to the first degree of inclination is equal to any one of the plurality of curved surface levels corresponding to the second degree of inclination in the case where any one of the plurality of curved surface levels corresponding to the first degree of inclination is not equal to any one of the plurality of curved surface levels corresponding to the second degree of inclination.

8. The drawing apparatus according to claim 1, further comprising a placing surface whose surface direction is set to a constant direction and the object insertion portion provided on the placing surface, wherein:

the processor includes an inclined state detection unit which detects an inclined state of the nail in the width direction thereof with respect to the surface direction of the placing surface, based on an image obtained by imaging the object inserted into the object insertion portion; and the processor controls the pressing forces applied to the object by the plurality of first pressing units respectively, based on a detection result of the inclined state obtained by the inclined state detection unit.

9. The drawing apparatus according to claim 1, further comprising a pair of second pressing units applying pressing forces to the right and left sides of the object, wherein the processor controls the pressing forces applied to the right and left sides of the object by the second pressing units when holding the object in the object insertion portion.

10. The drawing apparatus according to claim 9, wherein, in the case of pushing up one of the right and left sides of the object by using at least one first pressing unit corresponding to one of the right and left sides of the object in the plurality of first pressing units, the processor controls the second pressing unit to reduce the pressing force applied to the object by one second pressing unit, which is located on the other of the right and left sides of the object, in the pair of second pressing units so as to be smaller than the pressing force applied to the object by the other second pressing unit of the pair of second pressing units.

11. An operation control method of a drawing apparatus, wherein:

the drawing apparatus includes an object insertion portion into which an object is inserted, the object being at least one finger or toe having a nail and a plurality of first pressing units which apply pressing forces to the object inserted in the object insertion portion to hold the object in the object insertion portion;

the operation control method comprises a first pressing unit control step of controlling the pressing forces applied by the plurality of first pressing units respectively to adjust an inclination in a width direction of the nail of the object inserted in the object insertion portion.

12. The operation control method of the drawing apparatus according to claim 11, wherein:

the drawing apparatus includes a placing surface whose surface direction is set to a constant direction and the object insertion portion provided on the placing surface; and the first pressing unit control step includes controlling the pressing forces applied to the object by the plurality of first pressing units respectively so that the degree of inclination on one side in the width direction of the nail with respect to the surface direction of the placing surface comes close to the degree of inclination on the other side in the width direction of the nail with respect to the surface direction of the placing surface.

13. The operation control method of the drawing apparatus according to claim 11, wherein:

the drawing apparatus includes a drawing unit which forms a drawing on the nail; and the first pressing unit control step includes controlling the pressing forces applied to the object by the plurality of first pressing units respectively so as to bring the inclined state in the width direction of the nail close to the state in which the drawing unit is able to perform the drawing normally on both end sides in the width direction of the nail when the inclined state in the width direction of the nail is a state where the drawing unit is not able to perform the drawing normally on either one of the both end sides in the width direction of the nail.

14. The operation control method of the drawing apparatus according to claim 11, wherein:

the drawing apparatus includes a placing surface whose surface direction is set to a constant direction and the object insertion portion provided on the placing surface; and the operation control method further comprising:

an inclined state detection step of detecting an inclined state of the nail in the width direction thereof with respect to the surface direction of the placing surface, based on an image obtained by imaging the object inserted into the object insertion portion, wherein the first pressing unit control step includes controlling the pressing forces applied to the object by the plurality of first pressing units respectively, based on a detection result of the inclined state obtained by the inclined state detection step.

15. The operation control method of the drawing apparatus according to claim 14, wherein:

the inclined state detection step includes detecting the first degree of inclination on one end side in the width direction of the nail and the second degree of inclination on the other end side in the width direction of the nail; and the first pressing unit control step includes controlling the pressing forces applied to the object by the plurality of first pressing units respectively in directions that cause the first degree of inclination and the second degree of inclination to be equal to each other in the case where the first degree of inclination and the second degree of inclination are not equal to each other.

16. The operation control method of the drawing apparatus according to claim 15, wherein:

the first pressing unit control step includes a pressing force control step of temporarily reducing the pressing forces applied to a surface on the side opposite to the nail of the object by all of the plurality of first pressing units in the case where the first degree of inclination and the second degree of inclination are not equal to each other; and the first pressing unit control step includes controlling the pressing forces applied to the object by the plurality of first pressing units respectively in directions that cause the first degree of inclination and the second degree of inclination to be equal to each other after performing the operation of temporarily reducing the pressing forces by the pressing force control step.

17. The operation control method of the drawing apparatus according to claim 15, wherein:

the first pressing unit control step includes a curved surface level acquisition step of acquiring the nearest curved surface level among the plurality of curved surface levels different from each other in a preset degree of curve corresponding to each of the first degree of inclination and the second degree of inclination; and the first pressing unit control step includes controlling the pressing forces applied to the object by the plurality of first pressing units respectively so that any one of the plurality of curved surface levels corresponding to the first degree of inclination and any one of the plurality of curved surface levels corresponding to the second degree of inclination acquired by the curved surface level acquisition step are equal to each other in the case where any one of the plurality of curved surface levels corresponding to the first degree of inclination is not equal to any one of the plurality of curved surface levels corresponding to the second degree of inclination.

18. The operation control method of the drawing apparatus according to claim 11, wherein:

the drawing apparatus further includes a pair of second pressing units applying pressing forces to the right and left sides of the object; and the control method further includes a second pressing unit control step of controlling the pressing forces applied to the right and left sides of the object by the second pressing unit when holding the object in the object insertion portion.

19. The operation control method of the drawing apparatus according to claim 18, wherein, in the second pressing unit control step, in the case of pushing up one of the right and left sides of the object by using at least one first pressing unit corresponding to one of the right and left sides of the object in the plurality of first pressing units, the second pressing unit is controlled to reduce the pressing force applied to the object by one second pressing unit, which is located on the other of the right and left sides of the object, in the pair of second pressing units so as to be smaller than the pressing force applied to the object by the other second pressing unit of the pair of second pressing units.

* * * * *